US005510810A

United States Patent [19]

Nishijima et al.

[11] Patent Number: 5,510,810

[45] Date of Patent: Apr. 23, 1996

[54] DISPLAY SCREEN CONTROL APPARATUS

[75] Inventors: Akio Nishijima; Naoya Iwama; Syoji Suganami; Katsutoshi Suzuki, all of Iwaki, Japan

[73] Assignee: Alps Electric Co., Ltd., Tokyo, Japan

[21] Appl. No.: 349,698

[22] Filed: Dec. 5, 1994

Related U.S. Application Data

[63] Continuation of Ser. No. 148,302, Nov. 8, 1993, abandoned.

[30] Foreign Application Priority Data

Nov. 11, 1992 [JP] Japan ..... 4-301260

[51] Int. Cl.[6] ..... G09G 5/00

[52] U.S. Cl. ..... 345/156; 345/160; 345/161

[58] Field of Search ..... 345/156, 161, 345/160, 167, 184; 200/6 R, 9, 16 B, 16 C, 6 A, 5 R

[56] References Cited

U.S. PATENT DOCUMENTS

| | | | |
|---|---|---|---|
| 3,214,514 | 10/1965 | Schmid | 345/161 X |
| 4,382,166 | 5/1983 | Kim | 345/161 X |
| 4,680,577 | 7/1987 | Straayer et al. | 345/160 |
| 4,879,556 | 11/1989 | Duimel | 345/161 X |
| 4,910,503 | 3/1990 | Brodsky | 345/161 |
| 4,945,357 | 7/1990 | Tal | 345/161 X |
| 4,968,257 | 11/1990 | Yalen | 345/161 X |
| 5,034,574 | 7/1991 | Martovitz | 345/161 X |
| 5,252,821 | 10/1993 | Sugimura | 345/161 X |

*Primary Examiner*—Ulysses Weldon
*Attorney, Agent, or Firm*—Guy W. Shoup; Patrick T. Bever

[57] ABSTRACT

A display screen control apparatus for producing a plurality of control signals in response to pressing, tilting and rotating a single operation lever, the control signals being transmitted to control circuitry for controlling the position of a cursor on the display screen in response to the control signals. The display screen control apparatus includes a base upon which are formed a plurality of control switches, the operation lever being resiliently positioned over the control switches such that pressing the operation lever actuates a first control switch, tilting the operation lever actuates one of a plurality of second control switches, and rotating the operation lever actuates one of two third control switches.

10 Claims, 4 Drawing Sheets

DISPLAY SCREEN CONTROL APPARATUS

This application is a continuation of application Ser. No. 08/148,302, filed Nov. 8, 1993 now abandonded.

BACKGROUND OF THE INVENTION

1. Field of the Invention

The present invention relates to a display screen control apparatus for controlling an image on a display unit by operating a single operation lever and suitably applicable to, for example, a navigation system mounted on a vehicle, copy machine and the like.

2. Description of the Related Art

A conventionally known example a screen display control apparatus of the type is arranged such that 4 sets of push switches mounted on a printed circuit board at the same intervals of 90° is covered with an upper case, an operation lever is oscillatingly supported at the central position of the group of these push switches serving as a fulcrum and the position of a cursor, and the like on a display unit is controlled based on the turned-on signal of the push switch or switches selectively urged and driven by the operation lever. More specifically, in the conventional example, when an operator tilts the shaft portion of the operation lever extending to the outside of the housing composed of the combination of the printed circuit board and upper case, the one or two sets of push switches disposed in the direction toward which the shaft portion is tilted are urged and driven by the operation lever, and thus an image or cursor on the display unit can be moved in a desired direction by operating the single operation lever so that the screen display control apparatus can be conveniently used for, for example, the movement of a map in a navigation system, movement of a cursor in a personal computer, and the like.

Nevertheless, since the aforesaid conventional screen display control apparatus only selects a control signal by the direction in which the operation lever is tilted, when a different kind of functions are to be controlled, for example, when a map in a navigation system is to be enlarged or reduced, an operation member other than the operation lever must be operated. Since the operation lever must be spaced apart from the other operation member to a certain extent due to the restriction resulting from an operating space and design, however, an operator must move his or her hand and fingers in a large amount in a complicated manner to continuously control a plurality of kinds of functions, and thus a problem arises in that operability is extremely lowered. Note, this problem is not limited to the navigation system but also caused in personal computers and the like employing the conventional display screen control apparatus in the same way and, for example, in the case of the personal computers, an operation member for feeding a page and establishing set conditions is need in addition to the operation lever for moving a cursor.

An object of the present invention made by taking the problem of the aforesaid prior art into consideration is to provide a display screen control apparatus capable of controlling a plurality of kinds of functions by operating a single lever and excellent in operability.

SUMMARY OF THE INVENTION

The object of the present invention can be achieved by a display screen control apparatus which comprises an operation lever having a shaft portion oscillatingly, rotatably and upward/downward movably supported in an housing and projecting to the outside of the housing; tilt detection switches accommodated in the housing and urged and driven by the operation lever when the shaft portion is tilted in a particular direction; rotation detection switches accommodated in the housing for detecting the rotation of the operation lever; a fall detection switch accommodated in the housing and urged and driven by the operation lever when the operation lever is lowered: and a control circuit for controlling an image on a display unit based on a signal output from the group of the detection switches.

According to the above apparatus, when the shaft portion of the operation lever is tilted in any arbitrary direction, an turned-on signal can be output from the particular tilt detection switch disposed in the direction toward which the shaft portion is tilted, and thus, for example, an image or cursor on the display unit can be moved based on a control signal according to the tilted direction; when the operation lever is rotated, an turned-on switch can be output from the rotary detection switch, and thus, for example, the enlargement/reduction of an image and a page feed can be carried out by rotating the operation lever in a forward or backward direction; and when the operation lever is forcibly inserted, a turned-on switch can be output from the fall detection switch, and thus, for example, a coordinate position can be input or a power supply can be turned on and off by forcible inserting the operation lever.

DESCRIPTION OF PREFERRED EMBODIMENTS

Figure 1:
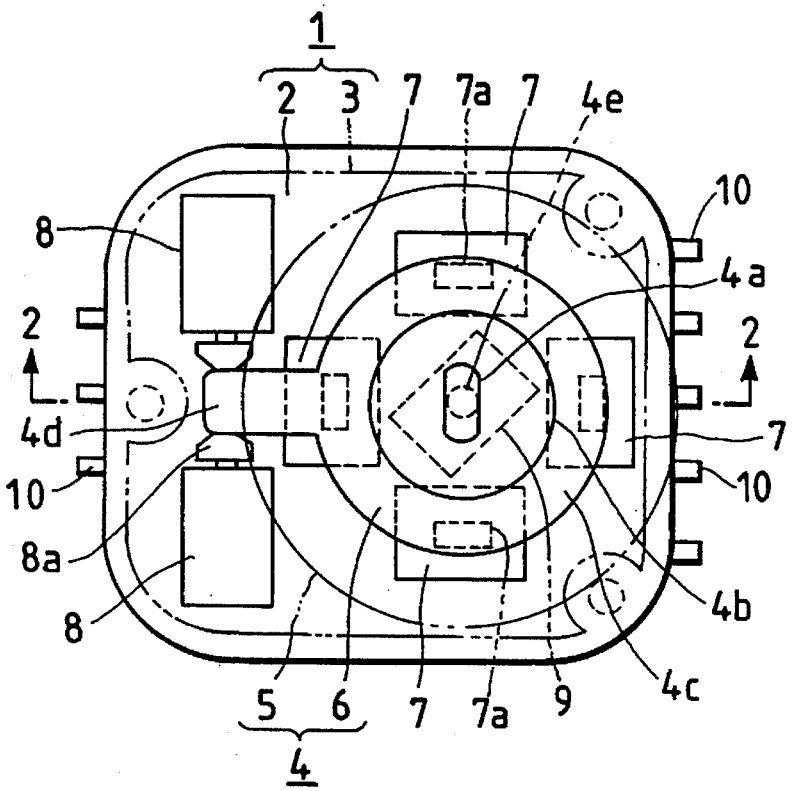
FIG. 1 is a plan view showing the internal structure of an input device according to a first embodiment of the present invention.
Figure 2:
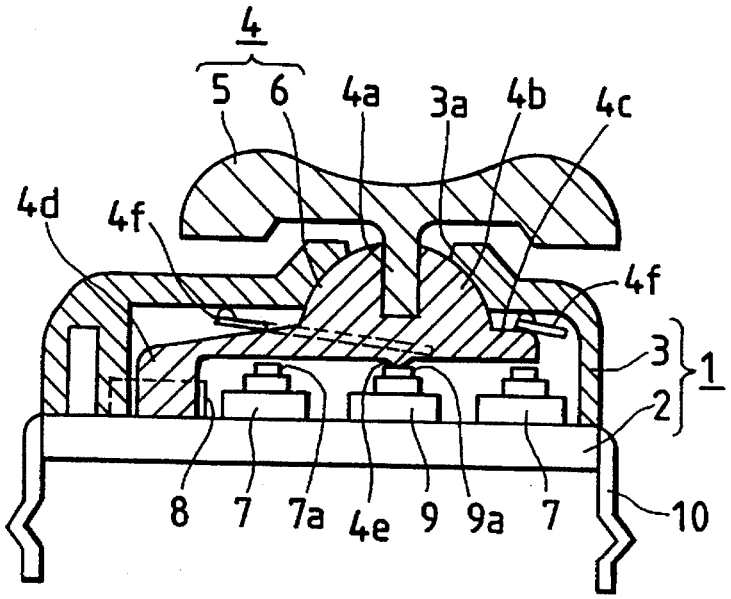
FIG. 2 is a cross sectional view taken along the line 2—2 of FIG.

Embodiments of the present invention will be described below with reference to the drawings. FIG. 1 is a plan view showing the internal structure of an input device according to a first embodiment of the present invention and FIG. 2 is a cross sectional view taken along the line 2—2 of FIG. 1, wherein numeral 1 designates a housing composed of the combination of a lower case (wafer) 2 and an upper case 3; numeral 4 designates an operation lever composed integrally of a key 5 and a driving member 6; numeral 7 designates 4 sets of tilt detection switches disposed in the housing 1 at equal intervals of 90° ; numeral 8 designates 2 sets of rotation detection switches disposed in the housing 1 to confront each other; numeral 9 designates a fall detection switch disposed at the central position of the group of the tilt detection switches 7 in the housing 1: and numeral 10 designates external terminals for connecting the respective detection switches 7, 8, 9 to a not shown control circuit. Note, in this embodiment, each of the tilt detection switches 7 and the fall detection switch 9 are composed of a vertical type push switch having a stem 7*a*, 9*a* directed upward, respectively and the rotation detection switch 8 is composed of a horizontal type switch push switch having a horizontal stem 8*a*.

Further, the driving member 6 of the operation lever 4 is formed with a semi-spherical portion 4*b* into which the shaft portion 4*a* of the key 5 is inserted under pressure, a first collar-shaped urging portion 4*c* for covering the respective stems 7*a* of the group of the tilt detection switches 7, a second urging portion 4*d* extending horizontally from the first urging portion 4*c* and held between the both stems 8*a* of the group of the rotation detection switches 8, a third projection-shaped urging portion 4*e* mounted on the stem 9*a* of the fall detection switch 9 and elastic pieces 4*f* in elastic contact with the inside wall surface of the upper case 3 to prevent the chattering of the driving member 6, and the outside surface of the semi-spherical portion 4*b* comes into sliding contact with the inside wall surface of the peripheral edge portion of the opening 3*a* of the upper case 3. More specifically, the operation lever 4 is composed of the driving member 6 oscillatingly, rotatably and upward/downward movably supported on the stem 9*a* of the fall detection switch 9 in the housing 1 and the key 5 integrally formed with the driving member 6 through the shaft portion 4*a*. The lower end of the third urging member 4*e* serves as an oscillating fulcrum as well as the center of rotation, and in a non-operating state the not shown return spring in the fall detection switch 9 supports the operation lever 4 from the lower side thereof, the elastic pieces 4*f* regulate the tilt of the operation lever 4 and the not shown return springs in the rotation detection switches 8 regulate the rotation of the operation lever 4. Therefore, the operation lever 4 is maintained in such an attitude that no chattering is caused in any directions while enabling the shaft portion 4*a* to stand upright, in the non-operating state.

Incidentally, in the input device arranged as described above, when an operator tilts the shaft portion 4*a* in an arbitrary direction by a predetermined amount by urging the upper peripheral edge of the key 5 of the operation lever 4, the stem or stems 7*a* of the one or two sets of the tilt detection switches 7 located in the direction toward which the shaft portion 4*a* tilted are forcibly inserted into the first urging potion 4*c* of the driving member 6 and turned on, and thus the respective tilt detection switches 7 can be selectively turned on by selecting the direction toward which the shaft portion 4*a* is tilted. Further, when the operator rotates the key 5 of the operation lever 4 clockwise or counterclockwise in FIG. 1 by a predetermined amount of rotation, since the second urging portion 4*d* of the driving member 6 is rotated in the same direction in association with the key 5, the stem 8*a* of any one of the rotation detection switches 8 is forcibly inserted into the second urging portion 4*d* and turned on. Furthermore, when the operator forcibly inserts the upper central portion of the key 5 of the operation lever 4 by a predetermined amount, the stem 9*a* of the fall detection switch 9 is forcibly inserted into the third urging portion 4*e* of the driving member 6 and turned on. Then, the turned-on signals from the group of these detection switches 7–9 are output to the control circuit through the external terminals 10 so that the control circuit controls an image or images on a not shown display unit based on the turned-on signals.

Consequently, when a navigation system is arranged by using the above input device and control circuit, the operator can control a plurality of kinds of functions by operating the single operation lever 4. For example, when a map displayed on the display unit is to be moved, the shaft portion 4*a* need only be tilted in the direction toward which the map is moved, and further when the map is to be enlarged or reduced, the key 5 need only be rotated clockwise or counterclockwise, and further when a present position is to be input to the map, the key 5 need only be forcibly inserted in the direction just below it.

It should be noted that when the tilting force applied to the key 5 to tilt the shaft portion 4*a* is removed, the driving member 6 is forcibly returned about the third urging portion 4*e* serving as a fulcrum by the resilient force of the not shown return spring in the tilt detection switch 7 urged by the first urging portion 4*c*, and thus the operation lever 4 is automatically returned to the initial position shown in FIG. 2 where the shaft portion 4*a* is caused to stand upright. In the same way, when the rotating force applied to the key 5 is removed, the operation lever 4 is automatically returned to the initial position by the resilient force of the return spring in the rotation detection switch 8, and further when the forcibly inserting force applied to the key 5 is removed, the operation lever 4 is automatically returned to the initial position by the resilient force of the return spring in the fall detection switch 9.

As described above, according to the above embodiment, the operator can tilt, rotate and forcibly insert the single operation lever so that a turned-on signal can be selectively output from the seven sets in total of the group of the detection switches 7–9 by each operation effected by the operator. Therefore, when a different kind of functions can be controlled in accordance with an operation mode, three kinds of different functions such as the movement and enlargement/reduction of an image and the input of a coordinate position can be continuously carried out by operating the single operation lever 4 and as a result, operability can be greatly improved. Further, the total number of operation members can be reduced and the group of the detection switches can be intensively located by enabling the operation lever 4 to comply with a plurality of function so that there is obtained an advantage that a space factor can be improved and the size of the apparatus can be reduced.

Note, although the elastic piece 4*f* formed to the operation lever 4 is cause to come into elastic contact with the inside wall surface of the housing 1 to prevent the chattering of the operation lever 4 in the above embodiment, when a sponge or the like is interposed between the inside wall surface of the housing and the operation lever, the elastic piece may be omitted. Further, when a push switch having a large operating stroke is used as the respective tilt detection switches 7, the operation lever 4 can be supported in the non-operating state not only by the stem 9*a* of the fall detection switch 9 but also by the respective stems 7*a* of the 4 sets of the tilt detection switches 7 disposed therearound, and in this case since the operation lever 4 is supported at the five points in good balance and thus stabilized, the chattering prevention means such as the above elastic piece, sponge or the like is not needed.

Further, although the above embodiment is described with respect to the case in which the input device is applied to the navigation system, when the input device is applied to control, for example, an image or images on the display unit of a copy machine in addition to the navigation system, items such as density adjustment, size adjustment and the like can be selected by tilting the operation lever, items such as density, magnification ratio and the like and page feed can be carried out by rotating the operation lever, and set conditions can be established by forcibly inserting the operation lever. In the same way, when the input device is applied to a personal computer and family computer, a cursor and a character or characters can be moved by tilting the operation lever, page feed and scroll can be carried out by rotating the operation lever, and set conditions can be established by forcibly inserting the operation lever. Further, when the input device is applied to a car audio device, items such as tone quality, balance and the like can be selected by tilting the operation lever, set conditions can be established by rotating the operation lever, and a power supply can be turned on or off by forcibly inserting the operation lever.

Figure 3:
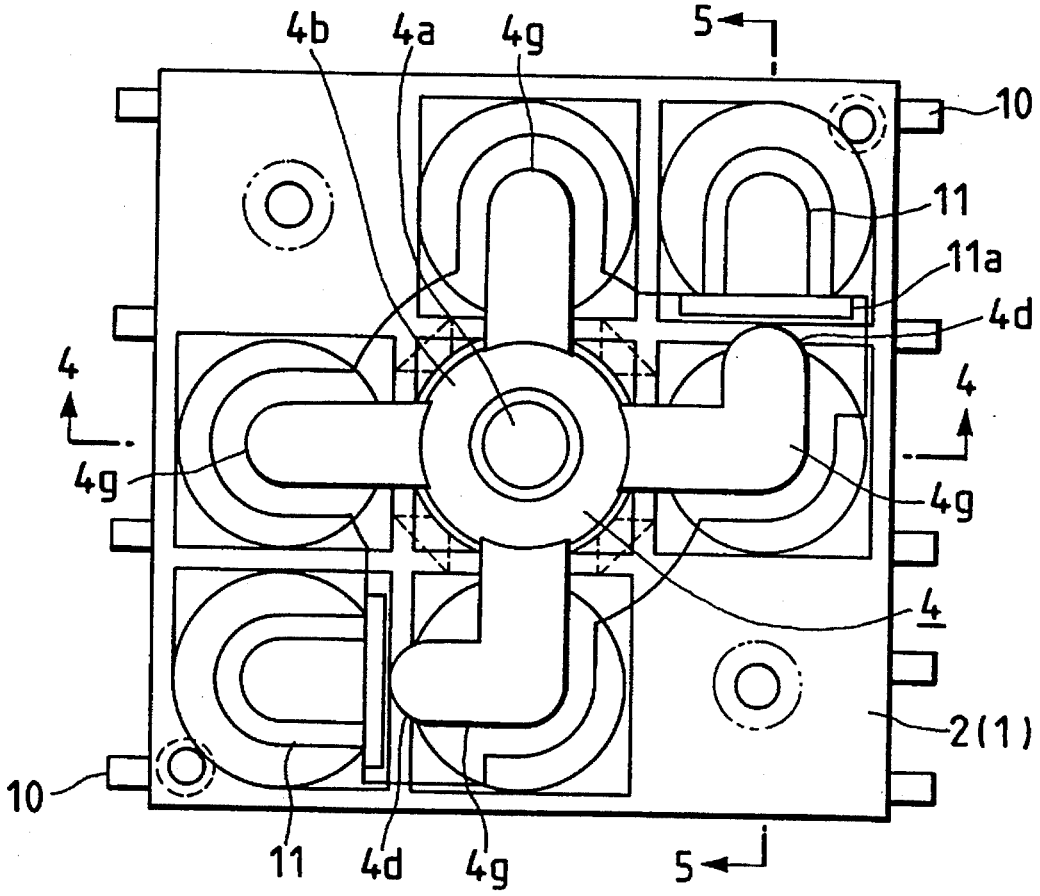
FIG. 3 is a plan view showing the internal structure of an input device according to a second embodiment of the present invention.
Figure 4:
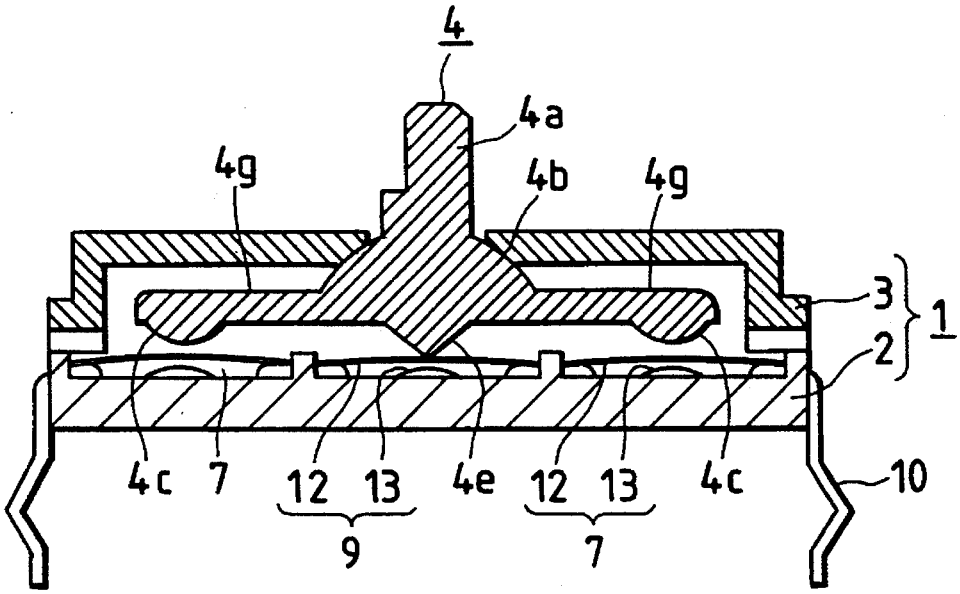
FIG. 4 is a cross sectional view taken along the line 4—4 of FIG.
Figure 5:
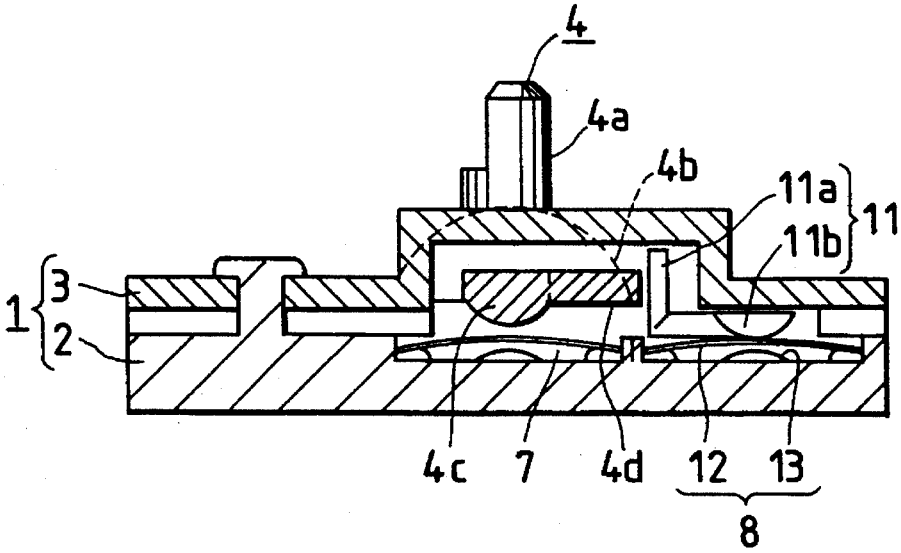
FIG. 5 is a cross sectional view taken along the line 5—5 of FIG.

FIG. 3 is a plan view showing the internal structure of an input device according to a second embodiment of the present invention, FIG. 4 is a cross sectional view taken along the line 4—4 of FIG. 3, and FIG. 5 is a cross sectional view taken along the line 5—5 of FIG. 3, wherein the same numerals as used in FIGS. 1 and 2 are used to designate corresponding parts and the description thereof is omitted if not necessary.

An operation lever 4 used in the second embodiment is composed of a shaft portion 4*a* projecting above a semi-spherical portion 4*b* and 4 sets of arms 4*g* projecting in the horizontal direction of the semi-spherical portion 4*b* at the same intervals. First urging portions 4*c* for urging and driving tilt detection switches 7 are defined to the extreme ends of the two sets of arms 4*g* extending in the upward direction and left direction and to the bent portions of the remaining two sets of hook-shaped arms 4*g* in FIG. 3, respectively. The extreme ends of the hook-shaped arms 4*g* are composed of second urging portions 4*d* for urging and driving a rotation detection switch 8 through actuators 11 disposed at the two positions in a housing 1. The two sets of the hook-shaped arms 4*g* have bent portions bent in opposite directions and the second urging portions 4*d* of the both arms 4*g* confront the standing-up portions 11*a* of the different actuators 11.

More specifically, when the operation lever 4 is rotated clockwise or counterclockwise in FIG. 3, any one of the hook-shaped arms 4*g* forcibly inserts the standing-up portion 11*a* of the corresponding actuator 11 to depress the driving portion 11*b* of the actuator 11,, and thus the rotational force applied to the operation lever 4 is converted into a downwardly urging force. Therefore, the rotation detection switch 8 is composed not of a horizontal type switch as in the first embodiment but of a vertical type switch which is turned on based on the lowering action of the driving portion 11*b* of the actuator 11. As a result, in this embodiment, all the group of the 7 sets of the detection switches 7–9 have the same arrangement provided with a resilient movable contact plate 12 disposed above a fixed contact 13 so that a switch structure is simplified and commonly arranged.

Figure 6:
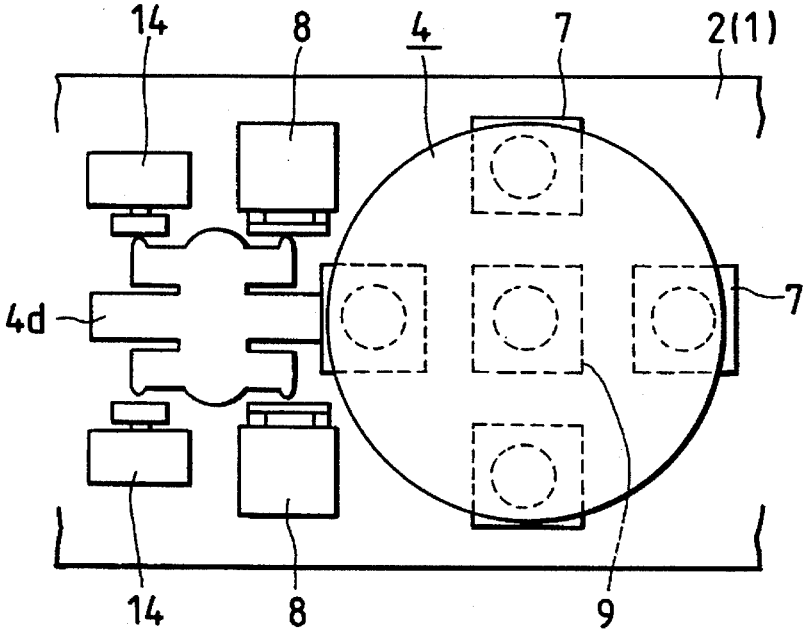
FIG. 6 is a plan view showing the internal structure of an input device according to a third embodiment of the present invention.

FIG. 6 is a plan view showing the internal structure of an input device according to a third embodiment of the present invention, wherein the same numerals as used in FIGS. 1 and 3 are used to designate corresponding parts and the description thereof is omitted if not necessary The third embodiment is arranged such that even if an operation lever 4 is rotated in any of a forward direction and backward direction, the second urging portion 4*d* thereof can urge and drive each 2 sets of rotation detection switches 8, 14 each having a different turning-on timing in accordance with an amount of rotation of the operation lever 4. More specifically, disposed on the lower case 2 of a housing 1 are the two rotation detection switches 8 to be urged and driven to the base end side of the second urging portion 4*d* and the two rotation detection switches 14 more spaced apart from the center of rotation of the operation lever 4 and to be urged and driven to the extreme end side of the second urging portion 4*d*, and when the operation lever 4 is rotated from a non-operating state, an amount of rotation of the operation lever 4 necessary to turn on the rotation detection switches 14 is set slightly larger than that necessary to turn on the rotation detection switches 8. Further, the rotation detection switches 8, 14 have an actuation force set to 100 gf and 260 gf, respectively, taking it into consideration that when the operation lever 4 is rotated, a driving force applied to the extreme end of the second urging portion 4*d* is larger than that applied to the base end thereof.

That is, when the operation lever 4 is rotated clockwise or counterclockwise in FIG. 6, the rotation detection switch 8 is first turned on and when the operation lever 4 is further rotated in the same direction, the rotation detection switch 14 is tuned on at the time when the rotation detection switch 8 is rotated excessively by a predetermined amount. Therefore, in this embodiment, four kinds of control signals can be taken out by suitably rotating the operation lever 4 in the forward and backward directions. As a result, the selection branches of control items which can be selected by rotation can be increased as compared with those of the first and second embodiments and thus this embodiment is preferable when there are many kinds of functions to be controlled.

Figure 7:
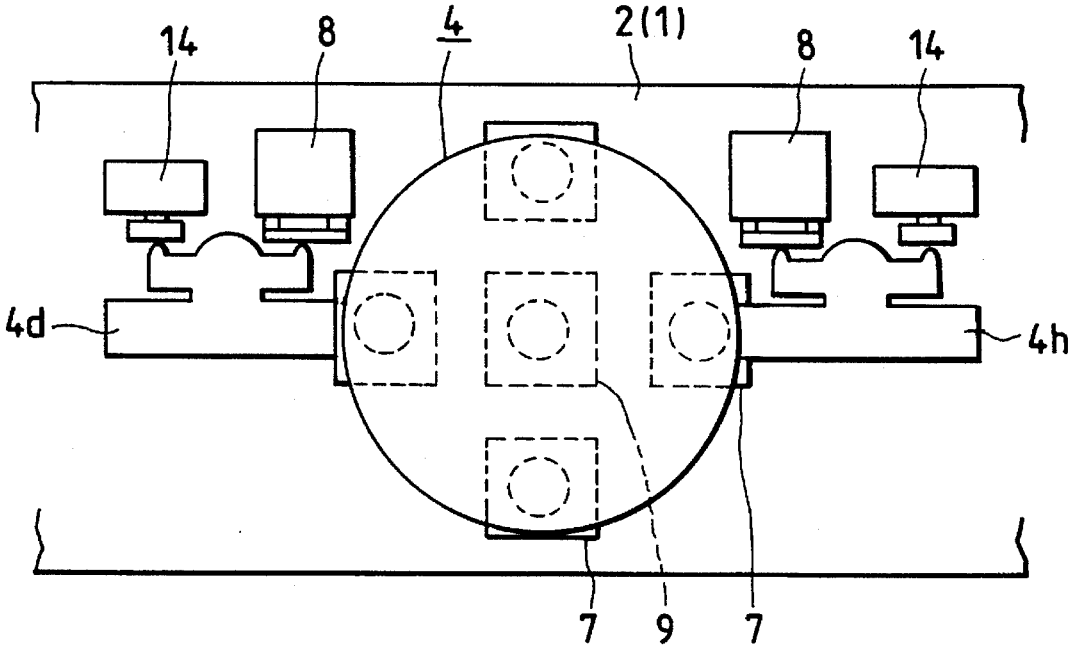
FIG. 7 is a plan view showing the internal structure of an input device according to a fourth embodiment of the present invention.

Note, as shown in a fourth embodiment shown in FIG. 7, the operation lever 4 may be provided with a pair of second urging portions 4*d*, 4*h* projecting therefrom and extending in a reverse direction each other so that any one of the second urging portions 4*d*, 4*h* urges and drives the rotation detection switches 8, 14 depending upon the rotational direction of the operation lever 4.

Further, although the aforesaid embodiments employ the push switch as the rotation detection switches, an optical switch having a light receiving/emitting element or a magnetic switch having a Hall effect element may be assembled as the rotation detection switches for detecting the rotation of the operation lever.

As described above, in the display screen control apparatus according to the present invention, since an operator can tilt, rotate and forcibly insert the single operation lever so that a turned-on signal can be selectively output from the group of the detection switches through the respective operations, three kinds of different functions such as, for example, the movement, enlargement/reduction of an image and an input of a coordinate position can be continuously carried out by operating the single operation lever. Therefore, the present invention can achieve the excellent effect of greatly improving operability as well as reduce the total number of operating members and further the group of the detection switches are intensively located, whereby an effect is obtained in that a space factor can improved and the size of the apparatus can be reduced.

What is claimed is:

1. A display screen control apparatus, comprising:

a housing including a base and a cover defining an opening;

an operation lever movably supported in the housing and having a shaft projecting through the opening formed in the cover, said operation lever being rotatable around an axis and including first, second and third actuating portions positioned in a common plane, the common plane being perpendicular to the axis;

a tilt detection switch mounted on the base and accommodated in said housing adjacent an outer edge of the operation lever, the tilt detection switch being actuated by the first actuating portion of said operation lever when said shaft portion is tilted in a particular direction relative to the housing;

a rotation detection switch mounted on the base and accommodated in said housing adjacent the outer edge of the operation lever, the rotation detection switch being actuated by the second actuating portion of said operation lever when said operation lever is rotated around the axis relative to the housing; and a press detection switch mounted on the base and accommodated in said housing opposite the opening, the press detection switch being actuated by the third actuating portion of said operation lever when said operation lever is pressed into the housing;

wherein said operation lever includes a curved outer surface held in sliding contact with an inner wall surface of said housing by a resetting force of at least one of said tilt, rotation and press detection switches.

2. A display screen control apparatus according to claim 1, wherein said rotation detection switch is a push switch.

3. A display screen control apparatus according to claim 2, wherein said apparatus further comprises:

second, third and fourth tilt detection switches disposed at equal intervals of 90° around said press detection switch; and a second rotation detection switch, said rotation switch being disposed at a first position where it is actuated by said operation lever when said operation lever is rotated in a forward direction, and said second rotation detection switch being disposed at a second position where it is actuated by said operation lever when said operation lever is rotated in a backward direction.

4. A display screen control apparatus according to claim 2, wherein rotation detection switch is located at a first distance from a center of rotation of said operation lever, and said apparatus further comprises a second rotation detection switch disposed at a second, different distance from the center of rotation of said operation lever so that said first and second rotation detection switches are turned on at different times depending upon an amount of rotation of said operation lever.

5. A device according to claim 1, wherein said operation lever includes a main body having a curved outer surface upon which are formed said first and second actuating portions, an upper portion from which said shaft extends out of said housing, and a lower surface including a projection forming said third actuating portion.

6. An input control device, comprising:

a housing including a base and an upper case forming an enclosed area, the base including a flat lower surface defining a plane, the upper case defining an opening;

an operation member including an actuating member movably disposed in the enclosed area and a shaft extending through the opening in the upper case, the operation member being rotatable around an axis, the axis being perpendicular to the plane defined by the base, the actuating member having first and second switch actuating portions;

a tilt detection switch mounted on the flat lower surface of the base and disposed opposite to said first switch actuating portion such that the tilt detection switch is actuated by said first switch actuating portion when said operation member is tilted in a predetermined direction relative to the housing;

a force converting member movably mounted in the enclosed area adjacent the second switch actuating portion, the force converting member having a first portion disposed to receive a horizontal force from said second switch actuating portion in response to a rotation of the operation member, and a second portion generating a vertical force in response to the horizontal force; and a rotation detection switch mounted on the flat lower surface of the base and disposed opposite to said second portion of said force converting member such that the rotation detection switch is actuated by said vertical force generating in response to rotation of said operation member.

7. A device according to claim 6, wherein said actuating member includes a main body having a curved outer surface and at least two arms projecting laterally from said main body at an equal angular interval around said main body, said first switch actuating portion being provided on a lower side of an outer end of each of said arms, said second switch urging portion being provided on lateral surfaces of two of said arms.

8. A device according to claim 6, wherein said tilt and rotation detection switches have fixed contacts disposed on the upper surface of said base.

9. A device according to claim 7, wherein the outer surface of said main body is held in sliding contact with an inner wall surface of a housing by a resetting force of said tilt detection switch.

10. A system including a multi-input control device for generating output signals from a group of detection switches arranged in a first plane within the device, the group of detection switches including a tilt detection switch urged and actuated by an operation lever when said operation lever is tilted in a preselected direction, a rotation detection switch for detecting the rotation of said operation lever around an axis of rotation, and a press detection switch urged and actuated by said operation lever when said operation lever is pressed, said device comprising:

an actuating member which integrally includes first, second and third switch urging portions for urging and actuating said group of detection switches;

wherein said first plane is perpendicular to said axis of rotation and contains the group of detection switches which are arranged so as to oppose a second plane containing a bottom surface of said actuating member.

* * * * *